US008553913B2

(12) United States Patent
Akino

(10) Patent No.: US 8,553,913 B2
(45) Date of Patent: Oct. 8, 2013

(54) CONDENSER MICROPHONE AND HEAD THEREOF

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 0 days.

(21) Appl. No.: 13/338,547

(22) Filed: Dec. 28, 2011

(65) Prior Publication Data

US 2012/0170777 A1 Jul. 5, 2012

(30) Foreign Application Priority Data

Dec. 29, 2010 (JP) ..... 2010-294378

(51) Int. Cl.
*H04R 25/00* (2006.01)

(52) U.S. Cl.
USPC ..... 381/174; 381/189

(58) Field of Classification Search
USPC ..... 381/355, 369, 360, 170–179, 189
See application file for complete search history.

(56) References Cited

U.S. PATENT DOCUMENTS 7,561,712 B2 * 7/2009 Akino ..... 381/361
7,729,131 B2 * 6/2010 Wang et al. ..... 361/818
2005/0123155 A1 * 6/2005 Song et al. ..... 381/174
2006/0078148 A1 * 4/2006 Akino ..... 381/369
2008/0144875 A1 * 6/2008 Akino ..... 381/361
2010/0290644 A1 * 11/2010 Wu et al. ..... 381/111
2011/0013789 A1 * 1/2011 Chen ..... 381/189

FOREIGN PATENT DOCUMENTS

JP 2008-072545 3/2008
JP 2008-166909 7/2008

* cited by examiner

*Primary Examiner* — Brian Ensey
*Assistant Examiner* — Norman Yu
(74) *Attorney, Agent, or Firm* — Whitham Curtis Christoffersonf & Cook, PC

(57) ABSTRACT

A head of a condenser microphone includes: a condenser microphone unit; a housing supporting the condenser microphone unit; a first circuit board arranged adjacent to the condenser microphone unit in the housing; a second circuit board arranged remote from the condenser microphone unit and separated from the first circuit board in the housing; and a magnetic sheet arranged between and separated from the first circuit board and the second circuit board in the housing, the first circuit board including a circuit for processing an audio signal from the condenser microphone unit; the second circuit board including a DC-DC converter circuit unit for generating a polarization voltage to be applied to the condenser microphone unit.

15 Claims, 6 Drawing Sheets

RELATED ART

RELATED ART

CONDENSER MICROPHONE AND HEAD THEREOF

BACKGROUND OF THE INVENTION

1. Technical Field

The present invention relates to a condenser microphone and a head of the condenser microphone that include a built-in electric source for accumulating electric charges for polarization.

2. Background Art

Some microphones, in particular wireless microphones can switch acoustic characteristics by replacing a microphone unit. Microphone units of such microphones are each composed of a dynamic microphone or a condenser microphone. Condenser microphones are categorized into an electret type and other types. In condenser microphones other than the electret type, in particular wireless condenser microphones, a built-in source circuit needs to generate a polarization voltage and supply this polarization voltage to a capacitor consisting of a diaphragm and a fixed electrode facing each other to accumulate electric charge in this capacitor. Such a condenser microphone is referred to as a DC biased condenser microphone. The present invention relates to a condenser microphone including a built-in electric source for accumulating electric charge for polarization.

Condenser microphones have already been commercialized which includes a built-in electric source for generating a polarization voltage. Since a voltage across a battery accommodated in a condenser microphone is not sufficiently high for a polarization voltage of the condenser microphone, the condenser microphone includes a built-in source circuit including a DC-DC converter for converting a low voltage across the battery into a high DC voltage to generate the polarization voltage. The DC-DC converter operates an oscillation circuit with a DC voltage from the battery to convert this DC voltage into an AC voltage and boosts this AC voltage severalfold while converting and smoothing the AC voltage into a DC voltage in a voltage doubler rectification circuit. Alternatively, some DC-DC converters boost an AC voltage with a transformer instead of the voltage doubler rectification circuit and then rectifies and smoothes this AC voltage.

FIG. 3 illustrates a typical circuit including a DC-DC converter circuit unit, a condenser microphone unit, and an impedance converter unit in the condenser microphone. In the DC-DC converter circuit unit 3, a battery is connected to a +V terminal and a GND terminal, and a voltage from the battery is supplied to an oscillation circuit 31 so that the oscillation circuit 31 operates to convert a DC voltage into an AC voltage. The oscillation circuit 31 includes a transistor Q3 as a main element and, for example, oscillation coils L01 and L02 and a feedback capacitor C10. An AC voltage generated in the oscillation circuit 31 is inputted to a voltage doubler rectification circuit 32 including capacitors C08 and C09, diodes D02 and D03, and a resistor R05 and is boosted severalfold while being rectified and smoothed. This boosted DC voltage is supplied as a polarization voltage through the resistor R05 to the condenser microphone unit 1.

As is well known, the condenser microphone unit 1 includes a diaphragm for vibrating by receiving sound waves and a fixed electrode facing the diaphragm at a predetermined distance, the diaphragm and the fixed electrode defining a capacitor. The polarization voltage is applied to either the diaphragm or the fixed electrode to accumulate electric charges in the capacitor. The diaphragm vibrates in response to received sound waves to change a gap between the diaphragm and the fixed electrode, and the capacitance of this capacitor is varied and is outputted as a change in electric signals.

The electric signals electro-acoustically converted in the condenser microphone unit as described above are outputted at high impedance and thus is inputted to the impedance converter circuit 2 to convert it into low impedance. The impedance converter circuit 2 includes an FET (field-effect transistor) Q01 as a main element having a bias circuit and a transistor Q02 as a buffer in the subsequent stage. An electric source for driving the impedance converter circuit 2 is supplied through the +V terminal from the battery. Impedance-converted audio signals are outputted as output signals of the microphone from a SIG terminal.

The condenser microphone including the built-in source circuit for generating the polarization voltage includes the DC-DC converter as described above. This DC-DC converter includes the oscillation circuit 31 outputting a high oscillation frequency of, for example, 1.4 MHz in order to convert a DC voltage into an AC voltage. The oscillation circuit 31 includes the oscillation coils L01 and L02 and outputs a high oscillation frequency as described above, is thus electromagnetically-coupled with other signal circuits readily, and causes the signal circuits to be unstable. Additionally, oscillation signals of the oscillation circuit 31 interfere with other circuits to thereby cause, for example, noise, which leads to poor performance of the microphone.

As is described with reference to FIG. 3, an FET is used as an active element of the impedance converter in the condenser microphone in order to decrease the output impedance. Significantly high input impedance of FET leads to electrostatic coupling of an input of the FET with oscillation signals of the oscillation circuit 31. The FET is thereby saturated by the oscillation signals also due to a high level of the oscillation signals and does not operate. Additionally, the oscillation signals are electromagnetically-coupled with the output of the microphone and outputted to interfere with an internal circuit of a device such as a mixer connected to the microphone, which may cause noise.

A DC-DC converter portion including an oscillation circuit is usually arranged separate from an impedance converter or an output circuit. FIGS. 5 and 6 exemplary illustrate a handy wired condenser microphone. In FIGS. 5 and 6, a long thin cylindrical microphone case 4 also functions as a grip. The top of the microphone case 4 functions as a microphone unit accommodating portion 41. The rear end of the microphone case 4 functions as a connecter 42 for connecting a microphone cable. In the microphone case 4, a long narrow circuit board 5 is arranged in the longitudinal direction of the microphone case 4 from the microphone unit accommodating portion 41 to the connecter 42.

On the circuit board 5, all circuits necessary for the condenser microphone are implemented. FIG. 6 illustrates arrangement of the circuits. On the circuit board 5 in FIG. 6, the impedance converter circuit 2, a low-cut buffer circuit 51, an inverting amplifier circuit 52, a voltage doubler rectification circuit 53, a DC-DC converter 54, a source ripple filter 55, and a signal output circuit 56 are arranged in the order from the microphone unit accommodating portion 41 toward the connecter 42. A circuit portion including the voltage doubler rectification circuit 53, the DC-DC converter 54, and the source ripple filter 55 corresponds to the DC-DC converter circuit unit 3 of the example in FIG. 3.

As is apparent from FIGS. 3 and 6, the DC-DC converter circuit unit 3 including the oscillation circuit is arranged separate from the impedance converter circuit 2. Thereby, the input of the FET in the impedance converter circuit 2 is intentionally prevented from being electrostatically-coupled with the oscillation signals of the oscillation circuit 31 in the DC-DC converter circuit unit 3.

As is apparent from FIGS. 3, 5, and 6, a handy condenser microphone has an enough space to arrange the circuits and thus protects the other circuits from interference of oscillation signals in the DC-DC converter circuit unit 3 relatively readily. However, a head of a wireless microphone, which has a built-in transmitter at its bottom, is as downsized as possible, and has circuit portions arranged closely. FIG. 4 illustrates a typical known head of a wireless condenser microphone.

FIG. 4 illustrates a cylindrical housing 61 functioning as a base of the head. A domal head case 62 is attached at the top of the housing 61. The housing 61 has a screw thread 611 for connecting the housing 61 to a main body of the microphone on the outer surface of the rear end thereof. An inner cylinder 63 is mounted to the inner surface of the housing 61 with proper shock-absorbing material therebetween. A cone insulator 64 is fixed on the inner surface at the top of the inner cylinder 63. The base end of a cylindrical unit supporter 69 is fixed on the outer surface at the top of the inner cylinder 63 to hold a condenser microphone unit 65 through the unit supporter 69. An electrode 651 projects from the center of the rear end of the condenser microphone unit 65. The microphone unit 65 and the insulator 64 are arranged interspatially to the inner surface of the head case 62 in the head case 62.

A circuit board 67 is fixed into the inner surface of the rear end of the inner cylinder 63. The electrode 651 of the microphone unit 65 is electrically connected to one end of an electrode bar 66, the other end of which is electrically connected to a predetermined land pattern on the circuit board 67. The polarization voltage is supplied from the DC-DC converter circuit unit through the land pattern, the electrode bar 66, and the electrode 651 to the condenser microphone unit 65. Audio signals outputted from the condenser microphone unit 65 are inputted through the electrode 651, the electrode bar 66, and the land pattern to a signal circuit on the circuit board 67. Circuit components necessary for the head of the wireless microphone, in addition to the impedance converter including the FET, are concentrated on the circuit board 67. The audio signals outputted from the condenser microphone unit 65 are impedance-converted and signal-processed by a circuit on the circuit board 67. The circuit board 67 also includes a signal-processing circuit, an output circuit, and the DC-DC converter for generating the polarization voltage of the condenser microphone unit 65 thereon. In order to prevent the condenser microphone unit 65 from being affected by an oscillator in the DC-DC converter, the circuit board 67 is arranged separate from the condenser microphone unit 65.

A terminal circuit board 68 is fixed to the inner surface of the rear end of the housing 61. The housing 61 is coupled with the main body of the microphone to electrically connect the circuit in the head of the microphone through the land pattern on the terminal circuit board 68 to the circuit in the main body of the microphone.

The head of the wireless microphone includes the impedance converter circuit 2 and the DC-DC converter circuit unit 3 as shown in FIG. 3 therein, since output circuits such as the low-cut buffer circuit 51 and the inverting amplifier circuit 52 shown in FIG. 6 are not necessary.

In the head of the conventional wireless condenser microphone as shown in FIG. 4, necessary circuits are concentrated in a limited space in order to downsize the head and implement the transmitter in the rear end. Thereby, high frequency signals generated in the oscillator of the DC-DC converter circuit unit 3 readily interfere with the impedance converter circuit 2, which leads to poor performance of the microphone.

A condenser microphone for shielding its inside from electromagnetic waves intruding from the exterior more effectively is disclosed in, for example, Japanese Patent Laid-Open Publication No. 2008-166909. In this condenser microphone including a front audio terminal in the front, a rear audio terminal on the side, a unidirectional microphone unit having a diaphragm and a fixed electrode facing each other across a spacer and a metallic mesh covering the rear audio terminal from its inside in a metallic cylindrical unit case, a coil spring for pushing and pressing the metallic mesh toward the inner surface of the unit case is provided.

A microphone for preventing electromagnetic waves from intruding from an output connecter into its inside is disclosed in, for example, Japanese Patent Laid-Open Publication No. 2008-72545. In this microphone, a double-side printed circuit board is arranged on a connecter and has a shield layer on one substantially entire side of this board and a filter circuit for preventing a high frequency current from intruding into a microphone case on the other side.

SUMMARY OF THE INVENTION

[Technical Problem]

Japanese Patent Laid-Open Publications Nos. 2008-166909 and 2008-72545 each disclose a microphone for shielding its inside from electromagnetic waves intruding from the exterior, and do not have a measure to avoid electromagnetic noise generated in its built-in circuit.

It is an object of the present invention to provide a condenser microphone and a head of the condenser microphone that exhibit improved performance without interference of electromagnetic noise generated in its built-in circuit with its signal circuit.

[Solution to Problem]

A head of a condenser microphone in accordance with a first aspect of the present invention includes: a condenser microphone unit; a housing supporting the condenser microphone unit at a top end thereof; a first circuit board arranged adjacent to the condenser microphone unit in the housing; a second circuit board arranged remote from the condenser microphone unit and separated from the first circuit board in the housing; and a magnetic sheet arranged between and separated from the first circuit board and the second circuit board in the housing, the first circuit board including a circuit for processing an audio signal from the condenser microphone unit; and the second circuit board including a DC-DC converter circuit unit for generating a polarization voltage to be applied to the condenser microphone unit.

A condenser microphone in accordance with a second aspect of the present invention includes the head in accordance with the first aspect connected to a main body of the microphone.

[Advantageous Effects of the Invention]

A first circuit board including a circuit for processing an audio signal from a condenser microphone unit is separated from a second circuit board including a DC-DC converter circuit unit. Additionally, a magnetic sheet is arranged between the first circuit board and the second circuit board. Thereby, a high frequency signal generated in the DC-DC converter circuit unit can be effectively protected from interference with the audio signal processed in the first circuit board. This can provide a condenser microphone and a head of the condenser microphone that generate reduced noise and exhibit improved acoustic characteristics even though the condenser microphone includes the DC-DC converter circuit unit for generating a polarization voltage.

DESCRIPTION OF EMBODIMENT

Figure 4:
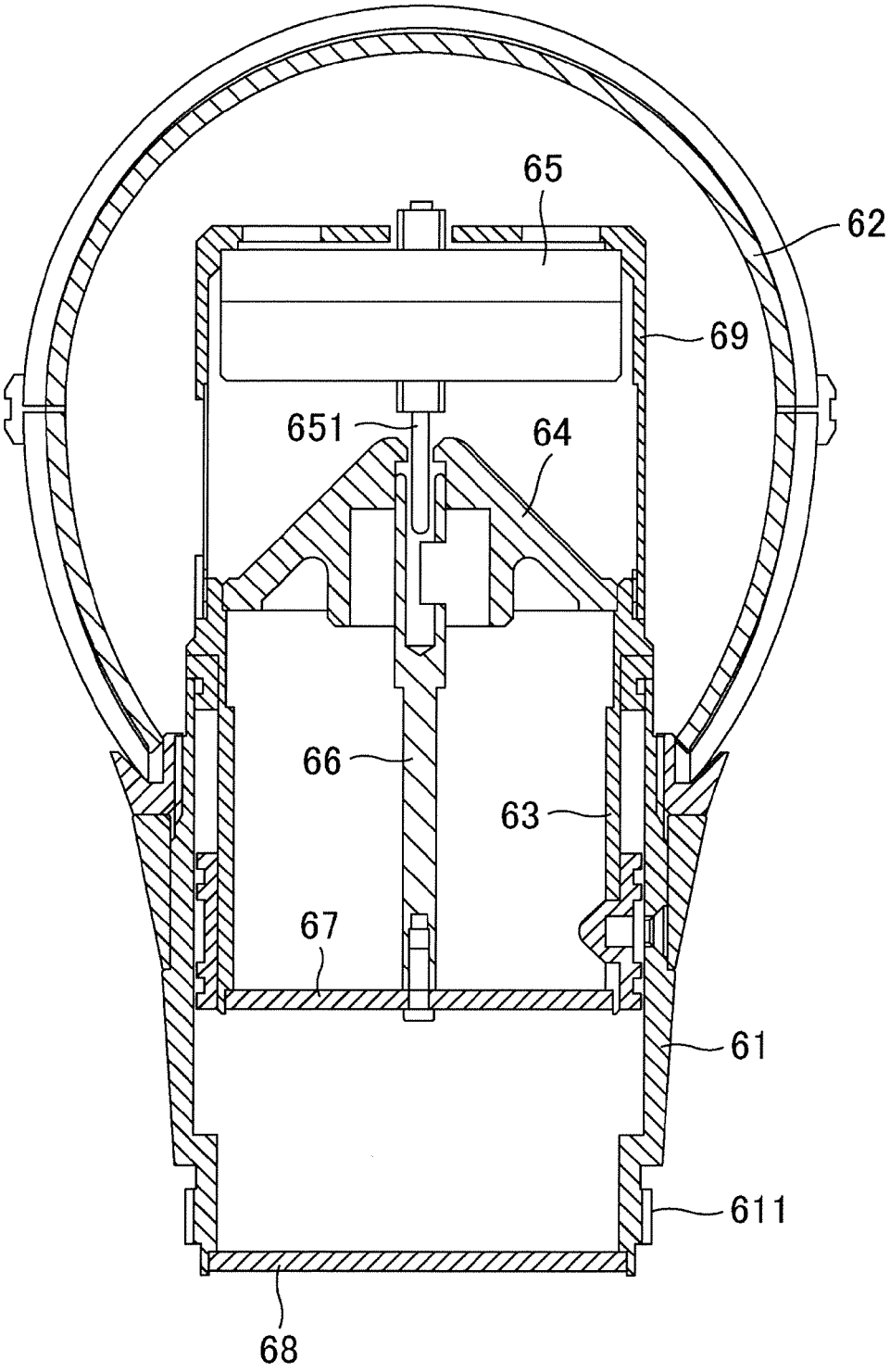
FIG. 4 is a longitudinal cross-sectional view illustrating a configuration of a head of a typical known condenser microphone.
Figure 5:
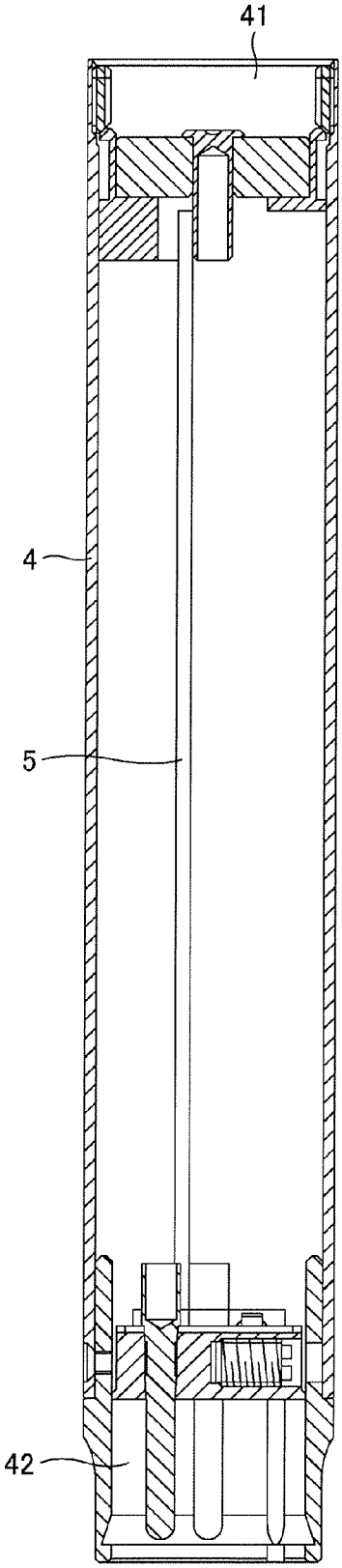
RELATED ART FIG. 5
FIG. 5 is a longitudinal cross-sectional view illustrating a main body of a typical known handy condenser microphone.
Figure 6:
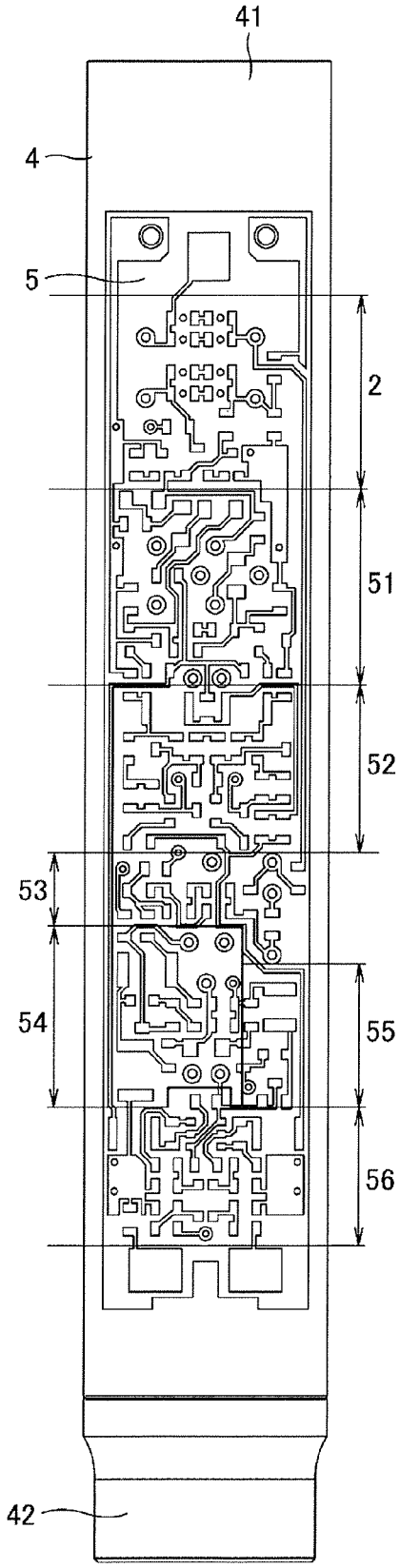
FIG. 6 is a front view illustrating a circuit board in the main body of the typical known handy condenser microphone.

A head of a condenser microphone in an embodiment of the present invention will now be described with reference to the accompanying drawings. The same elements as those of a head of a typical known condenser microphone shown in FIG. 4 are denoted by the same reference numerals.

[Embodiment]

Figure 1:
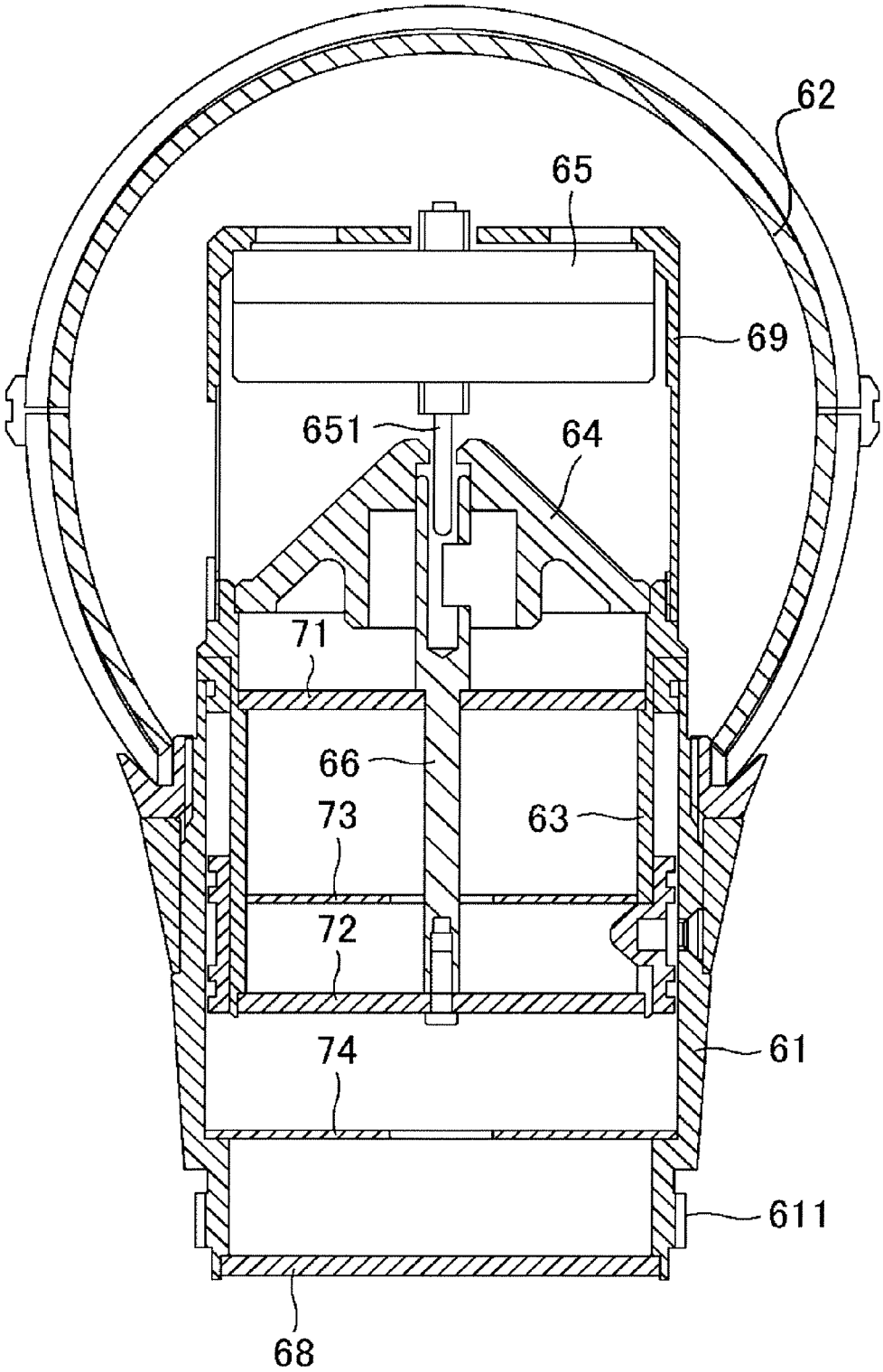
FIG. 1 is a longitudinal cross-sectional view illustrating a head of a condenser microphone in an embodiment of the present invention.

FIG. 1 illustrates a cylindrical housing 61 functioning as a base of the head. A domal head case 62 is attached at the top (upper part in FIG. 1) of the housing 61. The head case 62 has many holes so as to introduce sound waves into the head case 62. The housing 61 has a screw thread 611 on the outer surface of the rear end thereof as a portion for connecting the housing 61 to a main body of the microphone. An inner cylinder 63 is mounted to the inner surface of the housing 61 with proper shock-absorbing material therebetween. A cone insulator 64 is fixed on the inner surface at the top of the inner cylinder 63. The base end of a cylindrical unit supporter 69 is fixed onto the outer surface at the top of the inner cylinder 63 to hold a condenser microphone unit 65 with the unit supporter 69. An electrode 651 projects from the center of the rear end of the microphone unit 65. The microphone unit 65 and the insulator 64 are arranged interspatially to the inner surface of the head case 62 in the head case 62.

In the housing 61, a first circuit board 71 is fixed into the inner surface of the top end of the inner cylinder 63, in other words, adjacent to the microphone unit 65, and a second circuit board 72 is fixed into the inner surface of the rear end of the inner cylinder 63, in other words, remote from the microphone unit 65. The first circuit board 71 is separated from the second circuit board 72. The first circuit board 71 includes a circuit for processing an audio signal from the microphone unit 65, that is, an impedance converter circuit including an FET and a signal-processing circuit including a buffer and a filter, for example. The second circuit board 72 includes a DC-DC converter circuit unit for generating a polarization voltage to be applied to the condenser microphone unit 65.

The electrode 651 of the microphone unit 65 is connected to one end of an electrode bar 66. The electrode bar 66 penetrates through the first circuit board 71 to the second circuit board 72 and is fixed to the second circuit board 72 at its other end with a screw. The electrode 651 and the electrode bar 66 are surrounded by the insulator 64 to be stably aligned. Audio signals outputted from the condenser microphone unit 65 are inputted through the electrode 651 and the electrode bar 66 to an impedance converter circuit on the first circuit board 71. The impedance-converted audio signals are then processed by a proper signal processing-circuit on the first circuit board 71. The polarization voltage generated in the DC-DC converter circuit is applied to the electrode bar 66 through a predetermined circuit pattern on the second circuit board 72 and is then applied through the electrode 651 to the condenser microphone unit 65.

The first circuit board 71 is separated from the second circuit board 72 so as to prevent a circuit unit on the first circuit board 71 from being affected by an oscillator in the DC-DC converter circuit unit on the second circuit board 72. Additionally, a magnetic sheet 73 is disposed between and separated from the first circuit board 71 and the second circuit board 72 in the housing 61 in order to shield the first circuit board 71 from the second circuit board 72 more effectively. The magnetic sheet 73 is referred to as a first magnetic sheet. Another magnetic sheet 74 is arranged further distant from the condenser microphone unit 65 than the second circuit board 72 and separate from the second circuit board 72 in the housing 61. The magnetic sheet 74 is referred to as a second magnetic sheet.

The first and second magnetic sheets 73 and 74 may be composed of any material having electromagnetic shielding characteristics. In the embodiment shown in the drawing, these magnetic sheets are circular plates having conductive foil on both sides thereof for providing shielding characteristics. The outer peripheries of the first and second magnetic sheets 73 and 74 are in close contact with the inner surfaces of the inner cylinder 63 or the housing 61 such that the conductive foil on the first and second magnetic sheets 73 and 74 is in electrical contact with the inner cylinder 63 and the housing 61 to enhance shielding characteristics. The first magnetic sheet 73 has a clearance hole for the electrode bar 66 at its center so as not to be in electrical contact with the electrode bar 66.

The second circuit board 72 including an oscillation circuit is disposed between the first and second magnetic sheets 73 and 74. Thereby, high frequency signals generated in the oscillation circuit are blocked by the first and second magnetic sheets 73 and 74 and do not leak to the exterior of the first and second magnetic sheets 73 and 74. Since the high frequency signals do not interfere with the audio signals converted in the condenser microphone unit 65, the resulting audio signals have reduced noise and improved acoustic characteristics.

Figure 2:
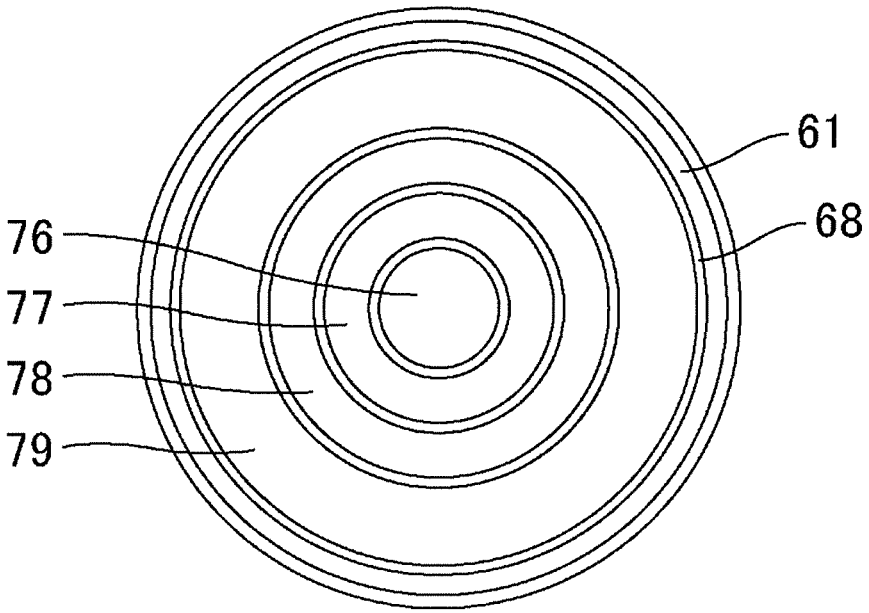
FIG. 2 is a bottom view illustrating the head in the embodiment.
Figure 3:
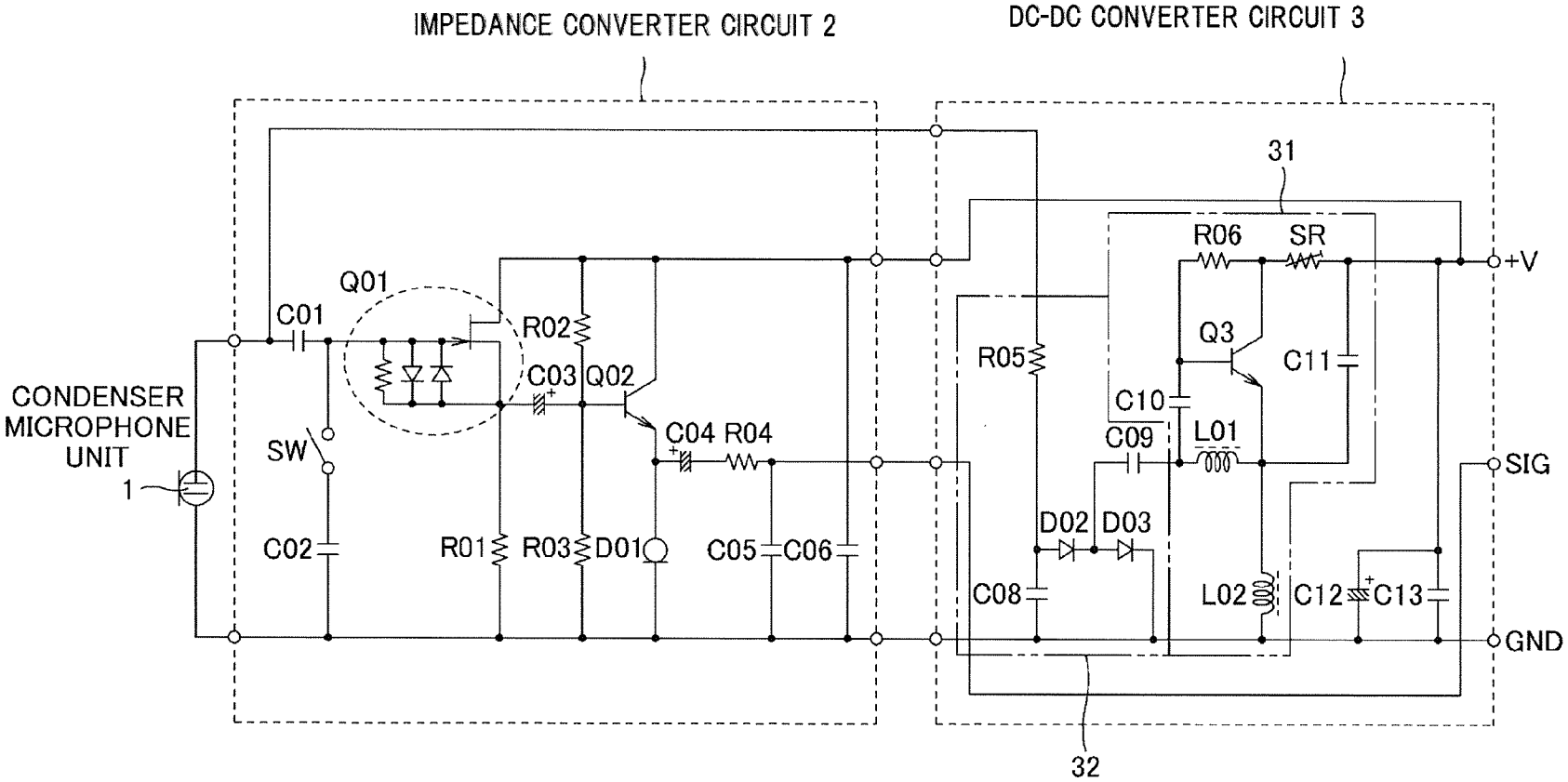
FIG. 3 is a circuit diagram illustrating an exemplary impedance converter circuit unit in a head of a condenser microphone and an exemplary DC-DC converter circuit unit for generating a polarization voltage.

A terminal circuit board 68 is fixed into the inner surface of the rear end of the housing 61. As shown in FIG. 2, the terminal circuit board 68 has concentric land patterns 76, 77, 78, and 79 disposed in sequence from the inside to the outside. The housing 61 containing the head of the condenser microphone has the screw thread 611 as a portion for connecting the housing 61 to the main body of the microphone. The housing 61 is coupled to the main body of the microphone with the screw thread 611 to electrically connect the circuit in the head of the microphone through the land patterns 76, 77, 78, and 79 on the terminal circuit board 68 to the circuit in the main body of the microphone and transfer the audio signals electroacoustically converted in the head to the circuit in the main body of the microphone.

The head of the condenser microphone as shown in FIG. 1 is connected to the main body of the microphone to complete a condenser microphone. A conductive sheet may substitute for the magnetic sheet or be utilized in combination with the magnetic sheet.

[Industrial Applicability]

The microphone unit may have an interchangeable structure in the present invention. The microphone unit may be a wireless or wired microphone unit, or may be of a handy, pin, or clip type. The present invention can be changed and modified without departing from the scope and spirit of the present invention on the basis of the accompanying claims.

What is claimed is:

1. A head of a condenser microphone comprising:

a condenser microphone unit;

a housing supporting the condenser microphone unit at a top end thereof;

a first circuit board arranged adjacent to the condenser microphone unit in the housing;

a second circuit board arranged remote from the condenser microphone unit and separated from the first circuit board in the housing; and a first magnetic sheet arranged between and separated from the first circuit board and the second circuit board in the housing, wherein the first circuit board includes a circuit for processing an audio signal from the condenser microphone unit, and wherein the second circuit board includes a DC-DC converter circuit unit for generating a polarization voltage for applying to the condenser microphone unit.

2. The head of the condenser microphone according to claim 1, wherein the circuit on the first circuit board includes an impedance converter circuit for decreasing output impedance of the condenser microphone unit.

3. The head of the condenser microphone according to claim 1, wherein a second magnetic sheet is arranged a further distance from the condenser microphone unit than the second circuit board and separated from the second circuit board in the housing.

4. The head of the condenser microphone according to claim 3, wherein a terminal circuit board for outputting the audio signal to an exterior thereof is arranged separate from the second magnetic sheet at a rear end of the housing.

5. The head of the condenser microphone according to claim 1, wherein the magnetic sheet has conductive foil on both sides thereof.

6. The head of the condenser microphone according to claim 3, wherein the second magnetic sheet has conductive foil on both sides thereof.

7. A head of a condenser microphone comprising:

a condenser microphone unit;

a housing supporting the condenser microphone unit at a top end thereof;

a first circuit board arranged adjacent to the condenser microphone unit in the housing;

a second circuit board arranged remote from the condenser microphone unit and separated from the first circuit board in the housing; and a first conductive sheet arranged between and separated from the first circuit board and the second circuit board in the housing, wherein the first circuit board includes a circuit for processing an audio signal from the condenser microphone unit, and wherein the second circuit board includes a DC-DC converter circuit unit for generating a polarization voltage for applying to the condenser microphone unit.

8. The head of the condenser microphone according to claim 7, wherein a second conductive sheet is arranged a further distance from the condenser microphone unit than the second circuit board and separated from the second circuit board in the housing.

9. The head of the condenser microphone, according to claim 7, wherein a magnetic sheet is arranged a further distance from the condenser microphone unit than the second circuit board and separated from the second circuit board in the housing.

10. A condenser microphone having a head of the condenser microphone, the head of the condenser microphone comprising:

a condenser microphone unit;

a housing supporting the condenser microphone unit at a top end thereof;

a first circuit board arranged adjacent to the condenser microphone unit in the housing;

a second circuit board arranged remote from the condenser microphone unit and separated from the first circuit board in the housing; and a first magnetic sheet arranged between and separated from the first circuit board and the second circuit board in the housing, wherein the first circuit board includes a circuit for processing an audio signal from the condenser microphone unit, wherein the second circuit board includes a DC-DC converter circuit unit for generating a polarization voltage for applying to the condenser microphone unit, and wherein the head is connected to a main body of the condenser microphone.

11. The condenser microphone according to claim 10, wherein a second magnetic sheet is arranged a further distance from the condenser microphone unit than the second circuit board and separated from the second circuit board in the housing.

12. The condenser microphone according to claim 10, wherein a conductive sheet is arranged a further distance from the condenser microphone unit than the second circuit board and separated from the second circuit board in the housing.

13. A condenser microphone having a head of the condenser microphone, the head of the condenser microphone comprising:

a condenser microphone unit;

a housing supporting the condenser microphone unit at a top end thereof;

a first circuit board arranged adjacent to the condenser microphone unit in the housing;

a second circuit board arranged remote from the condenser microphone unit and separated from the first circuit board in the housing; and a first conductive sheet arranged between and separated from the first circuit board and the second circuit board in the housing, wherein the first circuit board includes a circuit for processing an audio signal from the condenser microphone unit, wherein the second circuit board includes a DC-DC converter circuit unit for generating a polarization voltage for applying to the condenser microphone unit, and wherein the head is connected to a main body of the condenser microphone.

14. The condenser microphone according to claim 13, wherein a second conductive sheet is arranged a further distance from the condenser microphone unit than the second circuit board and separated from the second circuit board in the housing.

15. The condenser microphone according to claim 13, wherein a magnetic sheet is arranged a further distance from the condenser microphone unit than the second circuit board and separated from the second circuit board in the housing.

* * * * *